United States Patent [19]

Freeman

[11] Patent Number: 4,505,069

[45] Date of Patent: Mar. 19, 1985

[54] ANTI-INTRUSION SKYLIGHT BLIND

[76] Inventor: Delbert Freeman, 12634 Sun Valley Dr., Sun City, Ariz. 85351

[21] Appl. No.: 467,755

[22] Filed: Feb. 18, 1983

[51] Int. Cl.[3] ..... E06B 7/08

[52] U.S. Cl. ..... 49/64; 52/200

[58] Field of Search ..... 49/64, 86; 160/107; 52/200

[56] References Cited

U.S. PATENT DOCUMENTS 273,247 3/1883 Bickelhoupt ..... 49/86 X 4,427,048 1/1984 Osaska et al. ..... 49/64 X

FOREIGN PATENT DOCUMENTS 621762 6/1961 Canada ..... 49/64

*Primary Examiner*—Kenneth Downey

*Attorney, Agent, or Firm*—James F. Duffy

[57] ABSTRACT

An improved skylight blind for mounting in the light well of a skylight. The blind has a frame which defines a substantially rectangular opening through which visible light transmitted through the skylight can pass in order to enter the interior of a structure in which the skylight is incorporated. Slats are mounted on the frame so that when closed light is substantially not transmitted through the blind and when open the slats of the blind present a minimum of obstructions to such light. A motor plus controls opens and closes the blinds in response to manual controls or temperature and light sensitive controls. The slats and motor are enclosed between two planar sheets of an impact resistant and transparent material which planar sheets are secured to the frame to form an enclosure. The blind inhibits the use of the skylight as an unauthorized entry into the interior of a structure in which the skylight is mounted, while the impact resistant and transparent material provide significantly enhanced impediment to physical intrusion of the structure.

14 Claims, 3 Drawing Figures

ANTI-INTRUSION SKYLIGHT BLIND

BACKGROUND

1. Field of the Invention

This invention is in the field of blinds and more particularity relates to blinds for skylights which are provided with means for inhibiting unauthorized intrusion into the interior of a structure through a skylight and its associated light well.

2. Description of the Prior Art

Incorporating skylights into the roof structures of buildings is a well known and common way to provide natural lighting to the interior of a home or commercial structure. Locating blinds in the light well typically associated with these skylights to regulate the amount of light transmitted to the interior of a structure is also well known. It is also known to provide such blinds with electric motors and suitable controls so that the blinds can be opened or closed, or positioned in any intermediate position between the maximum open and the maximum closed positions to regulate the amount of light transmitted through such a blind to control the light intensity or the temperature in the interior of a structure, or to minimize heat loss or gain through a skylight.

As the number of skylights in use has increased, the criminal elements of society have discovered that skylights in structure can provide a readily accessable entry into such structures.

PRIOR ART STATEMENT

The following references are submitted under the provisions of 37 C.F.R. 1.97(b):

U.S. Pat. No. 1,888,522 Ward

U.S. Pat. No. 2,149,481 Van Bosch et al

U.S. Pat. No. 3,177,367 Brown

Ward, U.S. Pat. No. 1,888,522 discloses a skylight and its associated light well in which light well a skylight blind is located to regulate the amount of light entering a structure through the skylight and its associated light well. The position of the slats of Ward's blind are manually controlled.

Van Bosch et al, U.S. Pat. No. 2,149,481, discloses a window shade with a mechanism for raising and lower the shade which is controlled by temperature and light sensors.

Brown, U.S. Pat. No. 3,177,367, discloses a louvered device for covering windows. The position of the louvers are changed by a motor which is controlled by light sensors to control the amount of light entering a building.

SUMMARY OF THE INVENTION

The present invention provides an improved skylight blind which is located, or mounted, in the light well of a skylight of a structure to control the amount of light entering the structure through the skylight. The improved skylight blind of this invention has a frame which defines an open interior section. The frame is adapted to be mounted in a light well associated with a skylight. A plurality of slats, which are opaque, and pivotally mounted on the frame so that in their closed position the transmission of visible light from the skylight to the interior of the structure through the light well is substantially inhibited. When the slats are in their open position they provide a minimum degree of obstruction to the passage of light from the skylight to the interior of the structure. An electric motor is mounted on the frame and is mechanically connected to each slat to open or close the slats, or to position them in any position between fully opened and fully closed, including the extreme positions. Controlling the energization of the motor can be accomplished manually or in response to temperature and light sensitive devices.

To inhibit the use of a skylight and its associated light well as an unauthorized entry into a structure, two sheets of an impact resistant transparent plastic material are secured to the frame forming an enclosure. The slats and motor for positioning the slats of the blind are located within this structure. As a result, the skylight blind of this invention constitutes a difficult obstacle to be penetrated by one who attempts to enter the interior of a structure therethrough.

It is therefor an object of this invention to provide an improved skylight blind.

It is another object of this invention to provide an improved skylight blind which inhibits unauthorized entry into a structure through the skylight and its associated light well in which the skylight blind of this invention is mounted.

It is yet another object of this invention to provide an improved skylight blind in which the slats and mechanism for controlling the position of the slats of the blind are positioned between layers of impact resistant transparent material.

DESCRIPTION OF THE DRAWINGS

Other objects, features and advantages of the invention will be readily apparent from the following description of certain preferred embodiments thereof, taken in conjunction with the accompanying drawings although variations and modifications may be affected without departing from the spirit and scope of the novel concepts of the disclosure, and in which.

DESCRIPTION OF THE INVENTION

Figure 1:
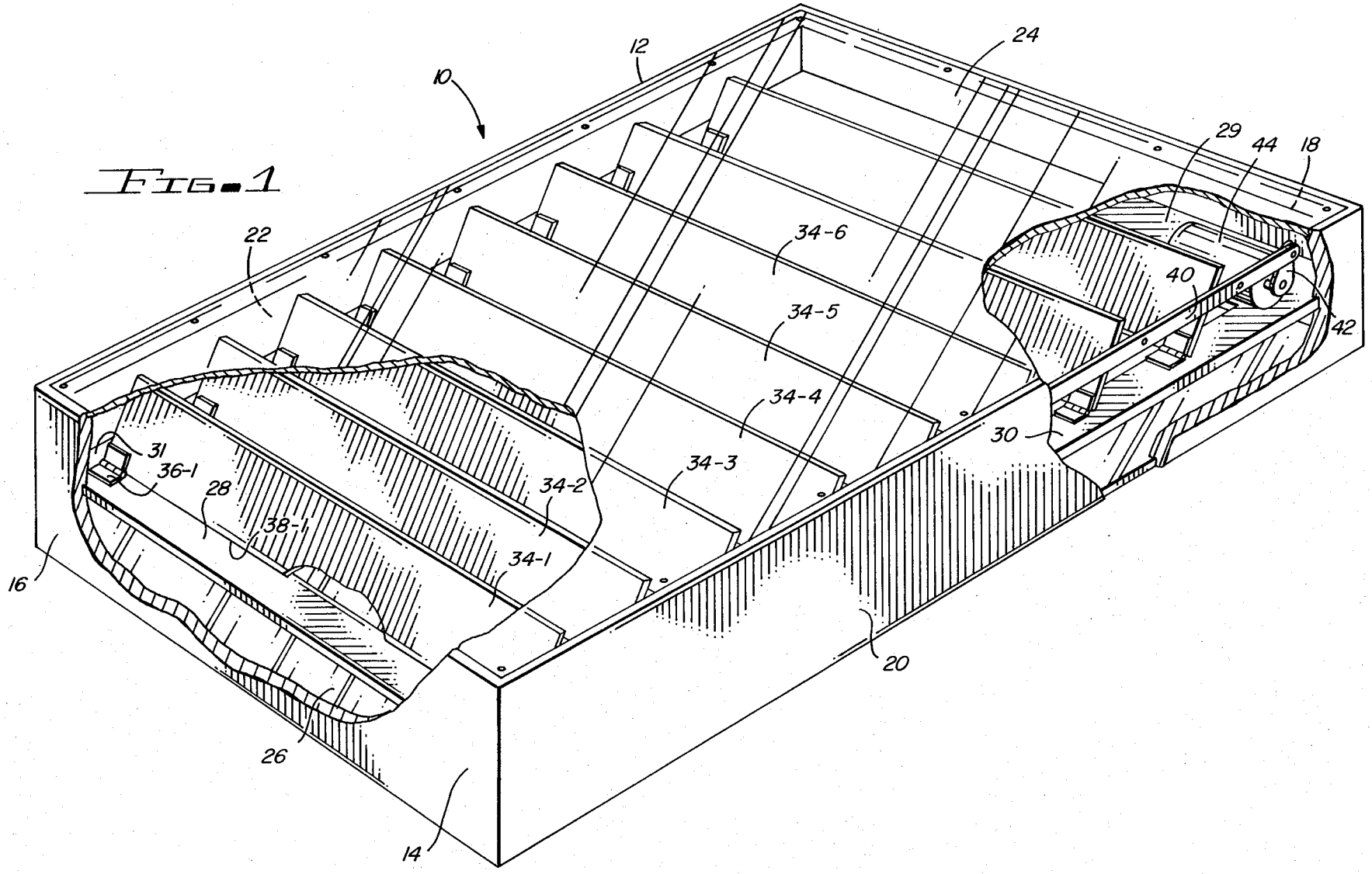
FIG. 1 is a perspective view of the anti-intrusion skylight blind.
Figure 3:
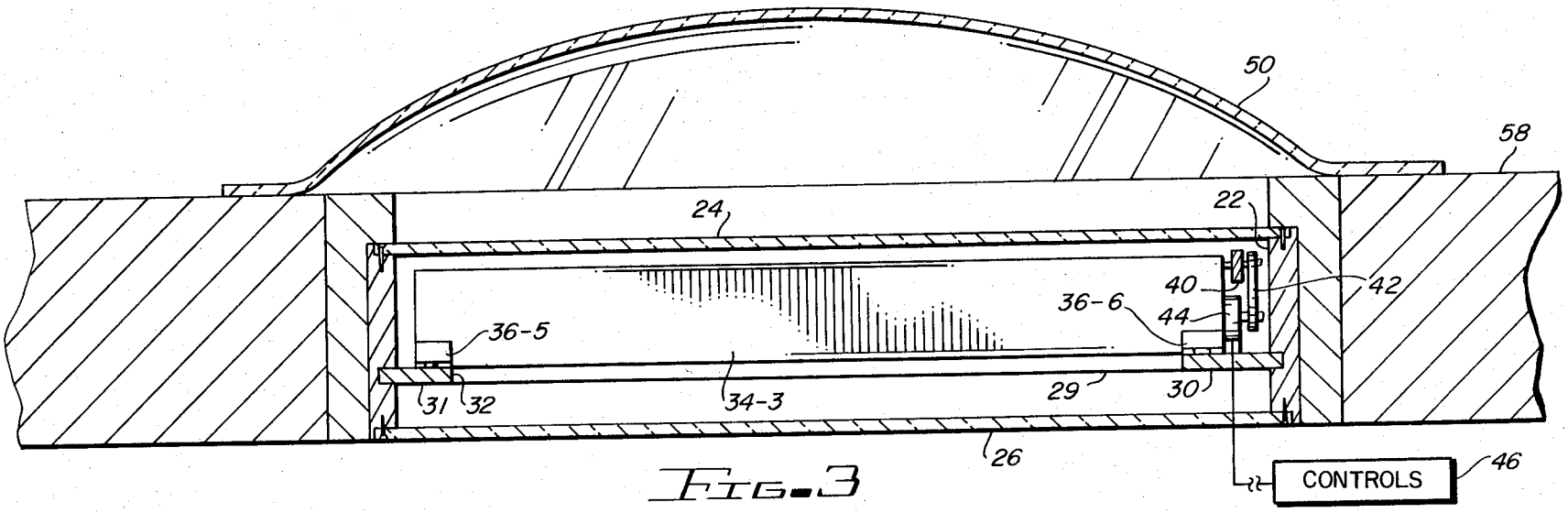
FIG. 3 is a sectional front elevation of the anti-intrusion skylight blind installed in a light well below a skylight.

In FIG. 1 skylight blind 10, in a preferred embodiment, includes a rectangular parallelepiped enclosure 12. The frame 14 of blind 10 is composed end members 16, 18 and side members 20, 22. The outer surfaces of members 16 through 22 are faces of parallelepiped enclosure 12. The upper base 24 and lower base 26 of enclosure 12 are substantially planor sheets which are made of an impact resistant light transparent material. Each of the members 16, 18, 20 and 22 of frame 14 is provided with an integral inwardly extending lateral extension 28, 29, 30 and 31 which substantially lie in a plane parallel to those of upper and lower bases 24, 26. The inner edges of extensions 28 through 31, such as edge 32 of extension 30 as seen in FIG. 4 defines an open interior section, or opening, through frame 14 which in the preferred embodiment is substantially rectangular. A plurality of slats, or louvers 34-1 to 34-6, which are illustrated in FIG. 3, are pivotally mounted on lateral extensions 30, 31 by means of pivot bearings or hinges 36-1 through 36-12, there being two hinges per slat 34.

The slats 34-1 through 34-6 are mounted on extensions 30, 31 so that they extend across the open interior section defined by the inner edges of extensions 28 through 31 and so that they are substantially parallel to one another and substantially equally distantly spaced from one another. In a preferred embodiment the lower edge of each slat 34-1 to 34-6 such as lower edge 38-1 of slat 34-1 substantially coincides with the pivot axis about which slat 34-1 is permitted to rotate by hinges 36-1 and 36-2. To rotate slats 34-1 through 34-6, each connected to a conventional reversable electric motor 44 so that slats 34-1 to 34-6 can be rotated from their open position as illustrated in FIG. 3 in which the slats 34-1 to 34-6 are substantially perpendicular to the surface defined by extensions 28 through 31 and thus substantially parallel to light passing through blind 10. In their open position, slats 34-1 through 34-6 present a minimum amount, or degree, of blocking or obstruction to light passing through blind 10. When rotated to their closed position, slats 34-1 through 34-6 are as close to being parallel as physically possible and thus substantially close off, or block, the open interior section of frame 14 and in doing so substantially block or obstruct the transmission of light through blind 10 and inhibit entry by an intruder.

Motor 44 is provided with conventional controls 46 which control the energization of motor 44 to cause it to rotate either clockwise or counter clockwise to open and shut slats 34-1 through 34-6, or to position the slats 34-1 through 34-6 in any intermediate position as well as in the fully open and fully closed positions. Controls 46 include conventional manually operated controls, and a limit switch to limit the extent to which crank 42 can be driven to those corresponding to the fully open and fully closed positions of the slats 34. The position of slats 34 can also be controlled by light intensity sensors which measure the intensity of light and that of the interior of the structure in which the skylight, sky well and skylight blind are incorporated or as a function of the temperature of the interior of such structure as is well known in the art.

Figure 2:
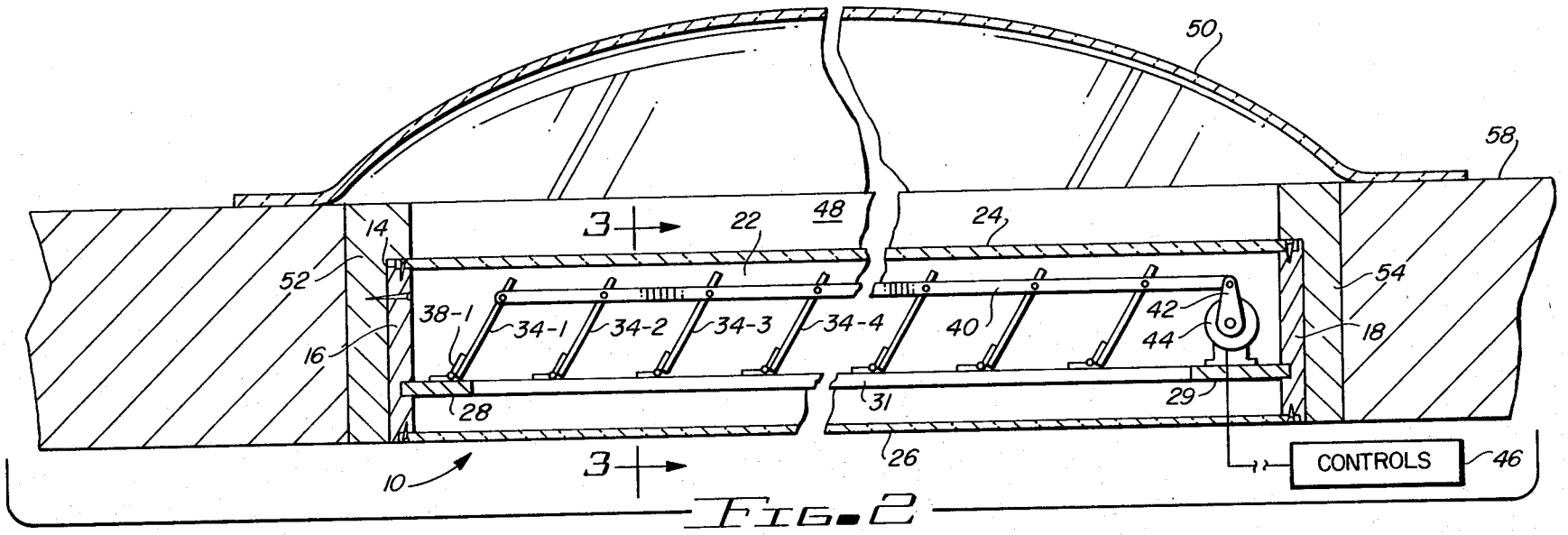
FIG. 2 is a sectional side elevation of the anti-intrusion skylight blind installed in a light well below a skylight.

In FIG. 2, the manner of installing, or mounting, skylight blind 10 in light well 48 associated with skylight 50 is illustrated. Light well 48 is typically frame, or determined by structural members such as beams 52,54, and cross braces between beams 52 and 54 such as cross brace 56 which is seen in FIG. 2. Beams 52 and 54 and the cross braces are part of the roof 58 of a conventional structure such as a home, or commercial or service type building. Skylight blind 10 is designed to be fixedly mounted in light well 48 and to essentially close it off as is best seen in FIG. 2.

Skylight 50 is typically made of a transparent material so that visible light from a source such as the sun outside of the structure of which roof 58 is a part can enter into the structure through light well 48 and blind 10 when the slats 34 of blind 10 are in their open position. Blind 10 can be mounted in light well 48 in any conventional manner such as by means of wood screws driven through members 16, 18, 20 and 22 into the beams 52 and 54 and cross braces or rails which are secured to the structural members defining light well 48 in any conventional manner. Frame 14 can be made of any suitable material such as metal, wood or plastic. If made of plastic it can be molded as a single entity, or can be assembled.

This louvered arrangement alone provides significant impediment to an intruder. Upper and lower bases 24 and 26 of enclosure 12 provide further impediment and are made of a light transparent impact resistant material such as a polycarbonate resin. Characteristics of polycarbonates are strength, dimensional stability, attractive appearance and transparency. Polycarbonates have outstanding heat stability, impact strength and dimensional stability over a wide range of temperatures and humidity conditions. Sheets of such material are commercially available from the General Electric Company under the trademark LEXAN.

The means for positioning slats 34-1 through 34-6 has been illustrated as being a reversable electric motor. Obviously other means for providing the power needed to control the position of slats 34 and of the amount of light transmitted through blind 10 other than those illustrated and described are possible.

From the foregoing description it is readily apparent that the skylight blind of the present invention when properly installed in a light well of a skylight will control the amount of visible light transmitted through the skylight and its associated light well into the interior of a structure in which the skylight is built while affectively inhibiting any unauthorized intrusion into the interior of the structure through the skylight and its associated light well.

Those skilled in the art will derive other embodiments drawn from the teachings herein. To the extent that such embodiments are so drawn, it is intended that such embodiments will fall within the ambit of protection provided by the claims set forth hereinafter.

Having described my invention in the foregoing specification and the drawings accompanying it in such a clear and concise manner that those skilled in the art may readily and easily practice the invention, I claim that which is set forth in the following claims.

I claim:

1. A skylight blind adapted to be positioned in a light well of a skylight to impede the passage of an intruder therethrough comprising:

frame means having an open interior section adapted to be mounted in said light well so that visible light from the skylight can be transmitted through said interior section;

a plurality of slats;

means for pivotally mounting the plurality of slats in said frame so that said slats have a closed position in which the slats provide a maximum degree of obstruction to physical egress through said light well and to the transmission of visible light through the interior section of the frame means and an open position in which the slats provide a minimum degree of obstruction to the transmission of visible light through the interior section of the frame means while still providing physical impediment to physical intrusion;

means for pivoting said slats between their open position and their closed position; and planar transparent and impact resistant means secured to the frame means, said transparent means and frame means forming an enclosure within which the slats and means for pivoting the slats are located, said transparent and impact resistant means further impeding physical intrusion through said light well.

2. A skylight as defined in claim 1 in which the frame means includes a pair of side members and end members.

3. A skylight as defined in claim 2 in which the slats are opaque to visible light.

4. A skylight as defined in claim 3 in which the means for pivotally mounting the slats in said frame are a pair of hinges for each slat.

5. A skylight as defined in claim 4 in which the enclosure is substantially a rectangular parallelepiped.

6. A skylight as defined in claim 1 in which the planar transparent and impact resistant means is a pair of sheets of material forming upper and lower bases of the enclosure.

7. A skylight as defined in claim 6 in which each of the sheets forming the upper and lower bases of the enclosure is made of a polycarbonate resin.

8. In a skylight blind having a frame and adapted to be fixedly mounted in a light well associated with a skylight mounted on a structure for controlling the amount of light entering the structure while impeding physical intrusion through said light well, the improvement comprising:

means mounted on said frame made of a transparent impact resistant material for inhibiting entry into said structure through the skylight, light well and skylight blind.

9. In a skylight blind as defined in claim 8 in which the means mounted on said frame is a pair of sheets of said material, said sheets being secured to said frame to form a prismatic structure.

10. In a skylight blind as defined in claim 9 in which the sheets of said material form the upper and lower bases of the prismatic structure.

11. In a skyline blind as defined in claim 10 in which the prismatic structure is a rectangular parallelpiped.

12. In a skylight blind as defined in claim 11 in which the transparent impact resistant material is a polycarbonate resin.

13. In cooperation with a skylight providing overhead daylight illumination through a light well to a structure's interior means for inhibiting unauthorized intrusion to the structure's interior comprising:

a plurality of slats mounted within a light well selectedly positionable to control light passage therethrough and to controllably inhibit physical intrusion therethrough;

means coupled to said plurality of slats for controlling the position of said slats;

means for housing said plurality of slats mounted within a light well; and said enclosure means comprises transparent, impact resistant panels for ingress and egress of light through said enclosure means for inhibiting physical intrusion through said enclosure means and the light well in which said enclosure means is mounted.

14. The means of claim 13 wherein said transparent, impact resistant panels comprise polycarbonate resin panels.

* * * * *